US007670271B2

(12) United States Patent
Finch

(10) Patent No.: US 7,670,271 B2
(45) Date of Patent: Mar. 2, 2010

(54) HANGING FITNESS DEVICE FOR ABDOMINALS

(76) Inventor: Stephen Brian Finch, 1750 Ellsworth, Gary, IN (US) 46404

( * ) Notice: Subject to any disclaimer, the term of this patent is extended or adjusted under 35 U.S.C. 154(b) by 506 days.

(21) Appl. No.: 11/320,367

(22) Filed: Dec. 28, 2005

(65) Prior Publication Data

US 2007/0149369 A1 Jun. 28, 2007

(51) Int. Cl.
*A63B 26/00* (2006.01)

(52) U.S. Cl. ..... 482/143; 482/140

(58) Field of Classification Search ..... 482/140, 482/38–40, 62, 69, 37, 904, 907, 91, 89, 482/139, 148, 143
See application file for complete search history.

(56) References Cited

U.S. PATENT DOCUMENTS 2,534,512 A * 12/1950 Fulton ..... 294/28
3,430,953 A * 3/1969 Teetor ..... 482/40
3,772,815 A * 11/1973 Burgess ..... 43/17.2
4,185,816 A * 1/1980 Bernstein ..... 482/140
4,468,022 A * 8/1984 Wu ..... 482/140
4,477,113 A * 10/1984 Lybolt ..... 294/16
4,494,750 A * 1/1985 Smith ..... 482/142
4,550,907 A * 11/1985 Melillo et al. ..... 482/140
4,603,858 A * 8/1986 Reehil ..... 482/123
4,679,788 A * 7/1987 Adler ..... 482/140
4,787,626 A * 11/1988 Gallagher ..... 482/140
4,958,586 A * 9/1990 Stupakis ..... 114/297
5,180,161 A * 1/1993 Jordan ..... 482/143
5,186,702 A * 2/1993 Amanze ..... 482/145
5,468,035 A * 11/1995 Fountain ..... 294/85
D369,841 S * 5/1996 Yang ..... D21/687
5,871,424 A * 2/1999 Conner ..... 482/129
5,910,073 A * 6/1999 Conner ..... 482/129
5,957,819 A * 9/1999 Cortesi ..... 482/121
5,989,167 A * 11/1999 Manley et al. ..... 482/140
6,113,523 A * 9/2000 Medina ..... 482/140
6,132,343 A * 10/2000 Eze ..... 482/97
6,183,403 B1 * 2/2001 Dunn ..... 482/121
6,196,949 B1 * 3/2001 Rodarte ..... 482/69
6,945,918 B1 * 9/2005 Hill ..... 482/106
7,066,866 B1 * 6/2006 Mobley ..... 482/40
2002/0128125 A1 * 9/2002 Simmons et al. ..... 482/93
2004/0032138 A1 * 2/2004 Bancroft ..... 294/67.22
2005/0250619 A1 * 11/2005 Daikeler et al. ..... 482/40
2006/0019799 A1 * 1/2006 Checketts ..... 482/38

(Continued)

*Primary Examiner*—Lori Baker
(74) *Attorney, Agent, or Firm*—Dale J. Ream

(57) ABSTRACT

A hanging fitness device for exercising abdominals includes a flatbed upper arm platform assembly having an arm cushion, vinyl cushion covering, two rubber non-skid floor stands, and a vertical stabilizer bar with an opening to connect to a vertical handle extender and a connector rod. The fitness device includes a safety bar assembly including a small opening that connects the safety bar to the flatbed upper arm platform assembly by a transverse member. The fitness device also includes a handle extender assembly with small vertical round openings on all four sides and horizontal insertion round bar with an inner V spring button. A hand grip unit assembly is configured to slidably receive the horizontal insertion bar of the handle extender, the insertion bar being locked therein by way of an inner V spring button. The device also includes a top hook assembly with a connection assembly to connect a height girder member of the hand grip unit assembly and the connector rod.

4 Claims, 7 Drawing Sheets

U.S. PATENT DOCUMENTS

2007/0094791 A1* 5/2007 Walker ..... 5/81.1 R
2007/0161470 A1* 7/2007 Berryman ..... 482/94
2008/0293545 A1* 11/2008 Planke ..... 482/7

* cited by examiner

HANGING FITNESS DEVICE FOR ABDOMINALS

BACKGROUND OF THE INVENTION

The present invention is directed generally to an exercise apparatus. More particularly, the present invention is directed to an apparatus for exercising on an overhead bar and more specifically an arm attachment apparatus for exercising the human abdominal muscles.

Exercising or working out can be accomplished in many ways and for a variety of reasons. People exercise to build and shape the body or to achieve general good health and fitness. Exercise routines can be as simple as walking, running or jogging or can be highly involved and structured to achieve a desired goal.

Gravity training as a form of exercise can be used not only for bodybuilding and toning but also can be used as a aerobic workout. In the past, gravity training was typically performed with the use of weight machines, free weights or on the floor itself. All have their advantages and disadvantages.

While the up and down movement of conventional sit-ups has it's advantages, such as specifically isolating and targeting a few midsection muscles, this movement can cause strain on the lower back muscles and spine. the positive effect of working your abdominal muscles comes at a price of sacrificing increased strength that relates to movements found in daily life.

Non impact gravity training, on the other hand, requires less impact on knees, joints and lower back and it tends to promote increased activity of more muscle groups. Non impact gravity training promotes stretching and relaxing in a way that conventional sit-ups and abdominal machines cannot. With non impact gravity training, less demands are made on the lower back that has to counteract the forward motion of the weight resisted shoulders and chest. With hanging non impact gravity training, safer workouts are accomplished though constant downward lower back stretching and movements.

Abdominal muscles are very important when it come to outward appearance of the human anatomy. This is the reason why there are so many different abdominal machines and gadgets for abs on the market today. When a conventional sit-up or a conventional abdominal machine is being used, not only are the abdominal muscles are in at work, but a host of other muscles are activated to help execute the movement. Most of the time though these movements, the lower back muscles has to take the stress of pressing against the hard surface of the floor or seat.

It is apparent that overhead bars and abdominal workouts can compliment each other. Exercise routines, especially ones that focuses on strength training should include exercises using modalities that helps stretch the muscles as well. such complimentary use of stretching and gravity is achievable when working out off the floor. However, when it came to working out the abdominal and midsection in the past. Conventional sit-ups and conventional abdominal machines were the only practical option.

There are seemingly many more knee and leg lift exercises that can be performed while off of the ground or floor than can be performed while pressing against the floor. The fact that one cannot eliminate the pressing against the floor without some form of hanging support, prevents the exercise person from benefiting from all the advantages that hanging nonimpact gravity workout has to offer.

Conventional abdominal machines are not designed for portability or mobility. Especially the ones that has heavy resistance weights as part of the machine. These machines are very costly and expensive to up keep. These machines are also large and can only be used in large health club facilities. Although conventional sit-ups can be performed almost anywhere, there is still the remaining problem of the neck and lower back constricting and overexerting themselves while lying on the floor. Even while performing leg lifts, lower back stress can easily occur. Also the constant repetitive back and forth movement of the head neck and shoulders causes dizziness and a desire not to continue the exercise. What is needed is a device which would allow the user to contract their midsection while at the same time stretch their lower back. This can most effectively be achieved though hanging nonimpact workout.

SUMMARY OF THE INVENTION

In accordance with the present invent, we will speak of this invention in the singular although two devices are needed in the usage of the invention. One for each arm. This is done because the devices are identical though out it's embodiment. In accordance with the present invention, there is provided a device for attaching a human body support system to an existing overhead secured bar. The device comprising of an upper arm horizontal support platform; a vertical safety support bracket; a vertical support beam; a vertical handle extension; a horizontal inner handle shaft; a spring button attached inside of the inner shaft; a removable push member connecting the vertical support beam and the vertical handle extension; a horizontal hand grip; a handle hook offset column; a vertical height extension; a wide top hook that attaches over an existing overhead bar; a transverse member applied through the front of the wide top hook; an inner push plate; two transverse members connecting the inner push plate to the wide top hook.

Also in accordance with the present invention, there is provided a device to permit the human body to exercise leg and knee lifts while being suspended slightly off the floor. The device comprising a upper arm platform assembly; foam rubber cushion; a flexible cushion covering; a vertical safety support bracket; a vertical handle extension with round openings spaced on all sides of the vertical handle extension to adjust the distance between the horizontal hand grip and the top of the upper arm platform.

Another device allowing a human body to be slightly suspended off the floor is provided according to the present invention. The device comprising a upper arm assembly with connector rod; a vertical handle extension that's permanently connected to a horizontal insertion shaft that slides into the horizontal hand grip; a spring button attached inside of the horizontal inner shaft of the handle extender unit which connects through a round opening on the inner shaft and through a round opening of the horizontal hand grip. The disconnection allows for a total detachment of the hand grip from all lower assembly of the device. This detachment allows the user to do conventional chin-ups and pull-up movements without the impedance of any other parts of the device.

DETAILED DESCRIPTION OF THE INVENTION

Figure 1:
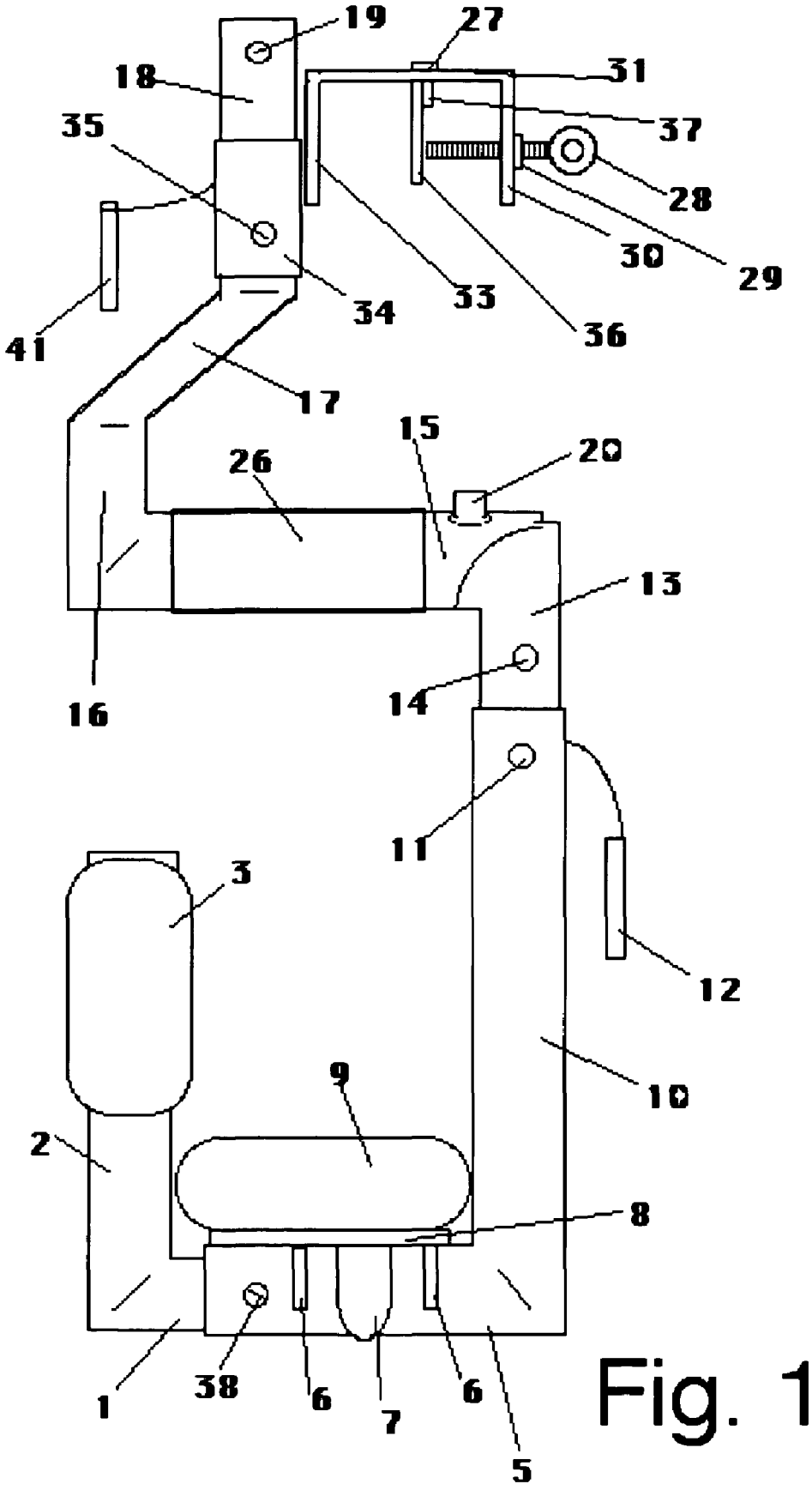
FIG. 1 is a side view of one embodiment of the device of the present invention, wherein the hand grip is positioned parallel to the arm cushion.
Figure 2:
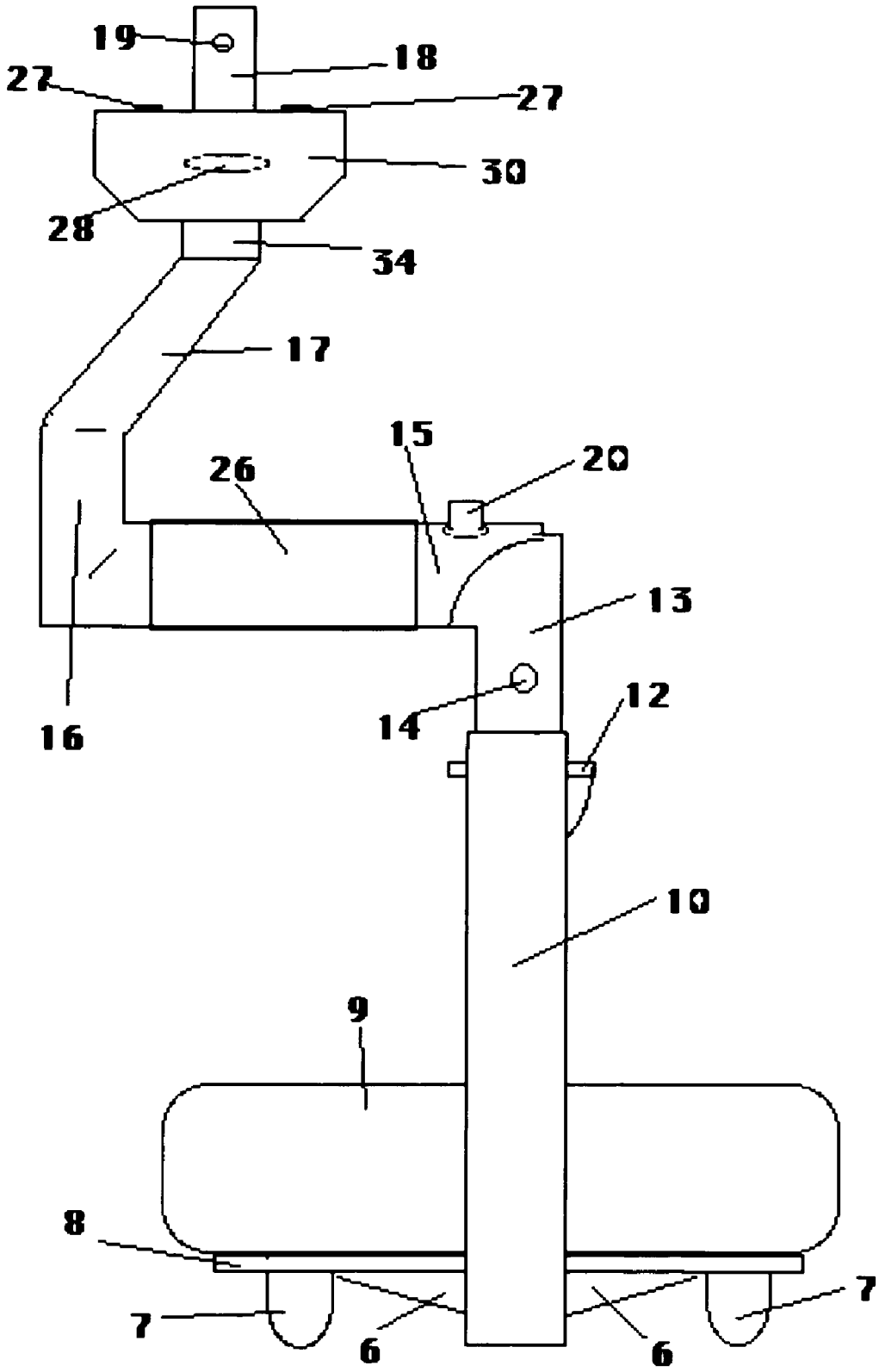
FIG. 2 is a front view of one embodiment of the device of the present invention, wherein the hand grip is positioned perpendicular to the arm cushion.

FIG. 1 shows one embodiment of the device of the present invention The device preferably has 6 primary sections. The safety bar assembly. The upper arm flat bed platform assembly, the handle extender assembly, the hand grip unit assembly, the top hook unit assembly with inner push plate.

In the illustrated embodiment 2 pens or transverse members comprise two adjustable sections which can accommodate a wide rage of forearm sizes and heights of the overhead bar. Alternatively the transverse member or removable pen rod can be designed as what is known as a snap-pen a three piece spring loaded mechanism which commonly used in the manufacture of fitness devices an would be permanently attached to the sides of the upper arm flat bed platform assembly round hole opening 11 and permanently attached to the side of the receiving shaft of the Top hook assembly round hole opening 35. In these descriptions and illustrations we will show the use of the removable pens.

Figure 3:
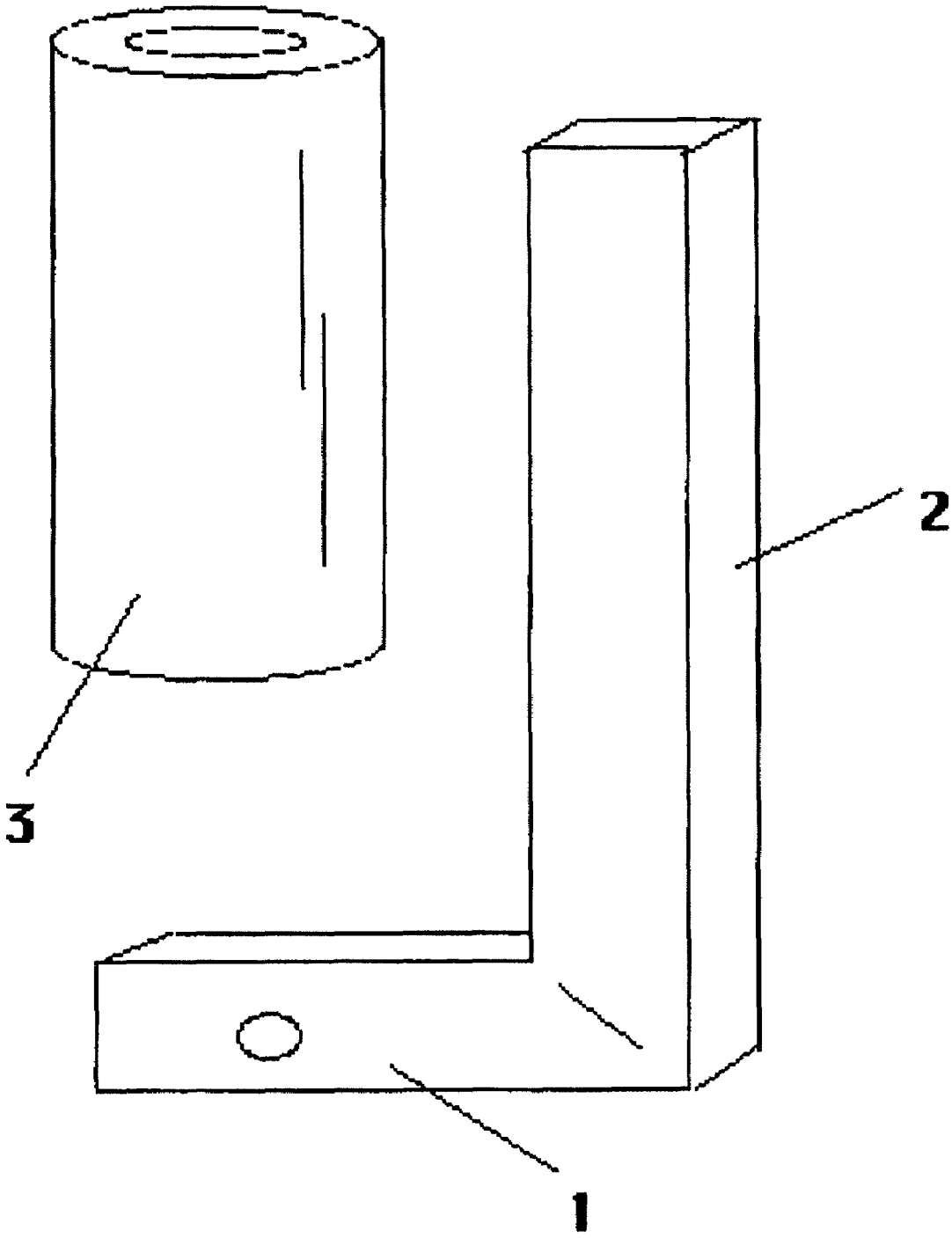
FIG. 3. is a side elevation view of the safety bar that is detached from the embodiment of FIG. 1.

The safety bar FIG. 3, which is L shaped in it's construction has four primary elements to it's construction. The first being a vertical girder 2, that helps keep the arm secured atop the upper arm platform assembly. The second portion is a beam 1, attached to the bottom which is horizontal, this beam connects the entire safety bar to the upper arm flat bed assembly. The third portion of the safety bar is a rubber tube covering 3, that envelopes the vertical girder which helps prevent friction. The fourth portion of the safety bar is one transverse member connector opening 38, which connects the safety bar to the upper arm flatbed platform assembly by way of theses round openings on the sides.

The shape and dimensions of the materials used for the upper arm flat bed platform assembly should be as such as to permit the safety bar 1, to easily fit securely within the opening on the end. The material used should be solid, non-bending and should not bend or break under the stress of human weight.

The material used in the description is a 1 and ¼ inch square solid hollow tubing with a 1/16 inch thick wall. The preferable dimensions of the flat plate 8, should be four inches long, by 6 inches wide forming a rectangular shape, the thickness of the material said here that being solid matter steel or aluminum should be that of 1/16th of an inch or greater.

Figure 4:
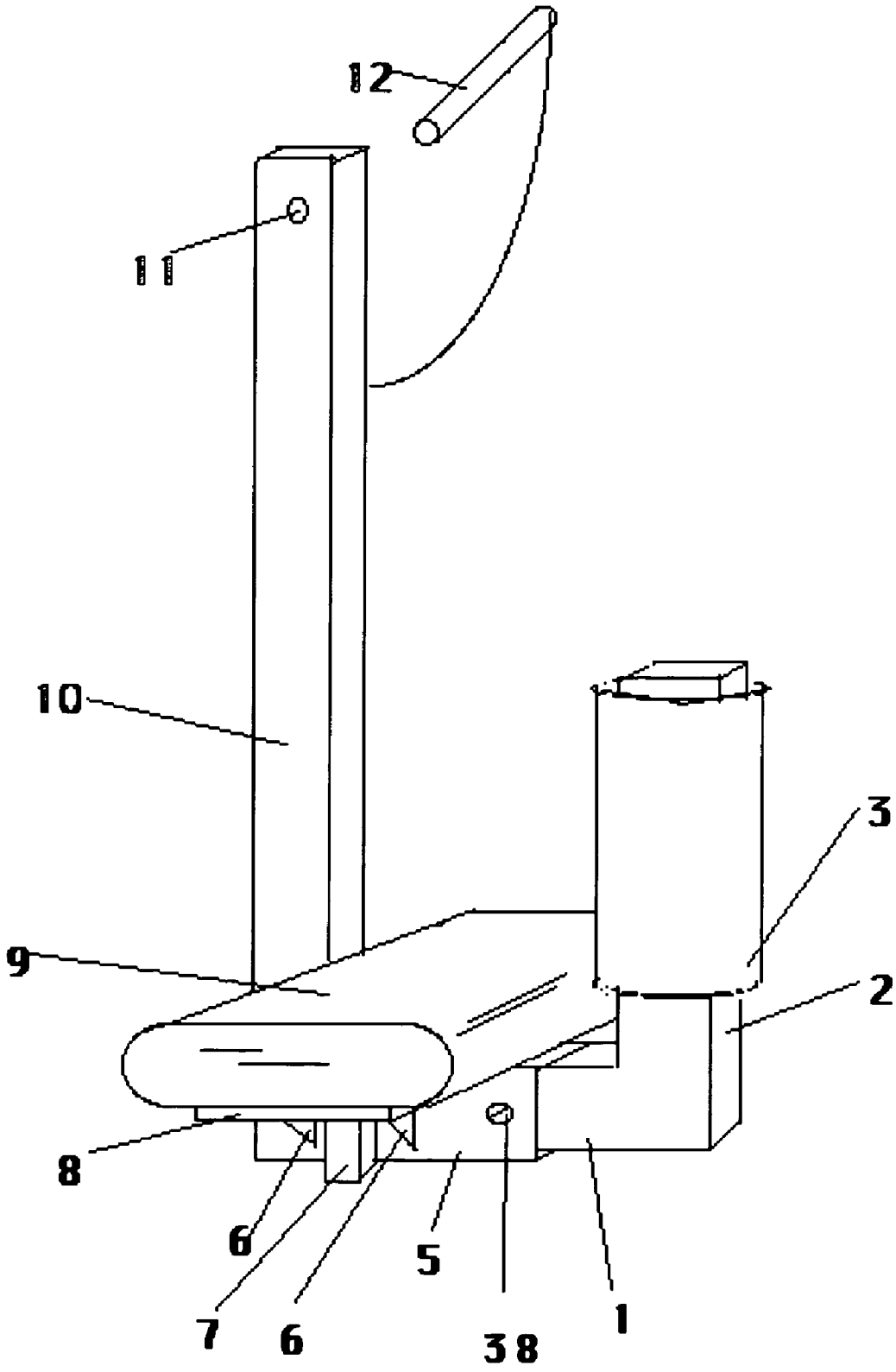
FIG. 4 is side elevation view of the upper arm flatbed platform assembly detached from the embodiment of FIG. 1.

The upper arm flatbed platform assembly FIG. 4 is L shape in it's construction on the top of the lower beam 5 is attached a flat plate 8. This flat plate serves as support for the arm cushion 9. Under the flat plate are attached four support brackets 6. these brackets serve as added strength for the flat plate. These said brackets are triangular in shape and are permanently attached on their edges to the side of the lower support beam 5 and to the bottom of the flat plate 8.

Positioned between the top of the flat plate 8 and the bottom of the 2 inch thick foam arm cushion 9 is a portion of wood, not shown, which is enveloped by the vinyl covering. This wood is ½ inch in thickness with the same 4×6 dimensions as the flat plate 8. The woods presence is to serve as an anchoring point for adhesives and/or staples for the vinyl covering of the foam rubber arm cushion 9. This wood portion is also an anchoring point for transverse members to be attached pointed from under the flat plate 8. This attachment keeps the cushion and covering secured on the flat plate.

FIG. 4 illustrates what is attached at a 90 degree right angle to the lower support beam 5 is a vertical support shaft 10. This said support shaft connects the upper arm flatbed platform assembly to the handle extender by the use of the removable pen 12. Attached to the bottom of the flat plate are two stands 7, preferably made of rubber that serve as feet, making the entire upper flat bed assembly unit capable of standing up on the floor unassisted. There is envisioned many different ways to attach the rubber feet 7, one is using a liquid adhesive or glue, another is using a transverse member upwards through an opening in the center the rubber foot 7, then through an opening in the flat plate 8, and then having it anchored in the wood portion of the arm cushion 9.

Figure 6:
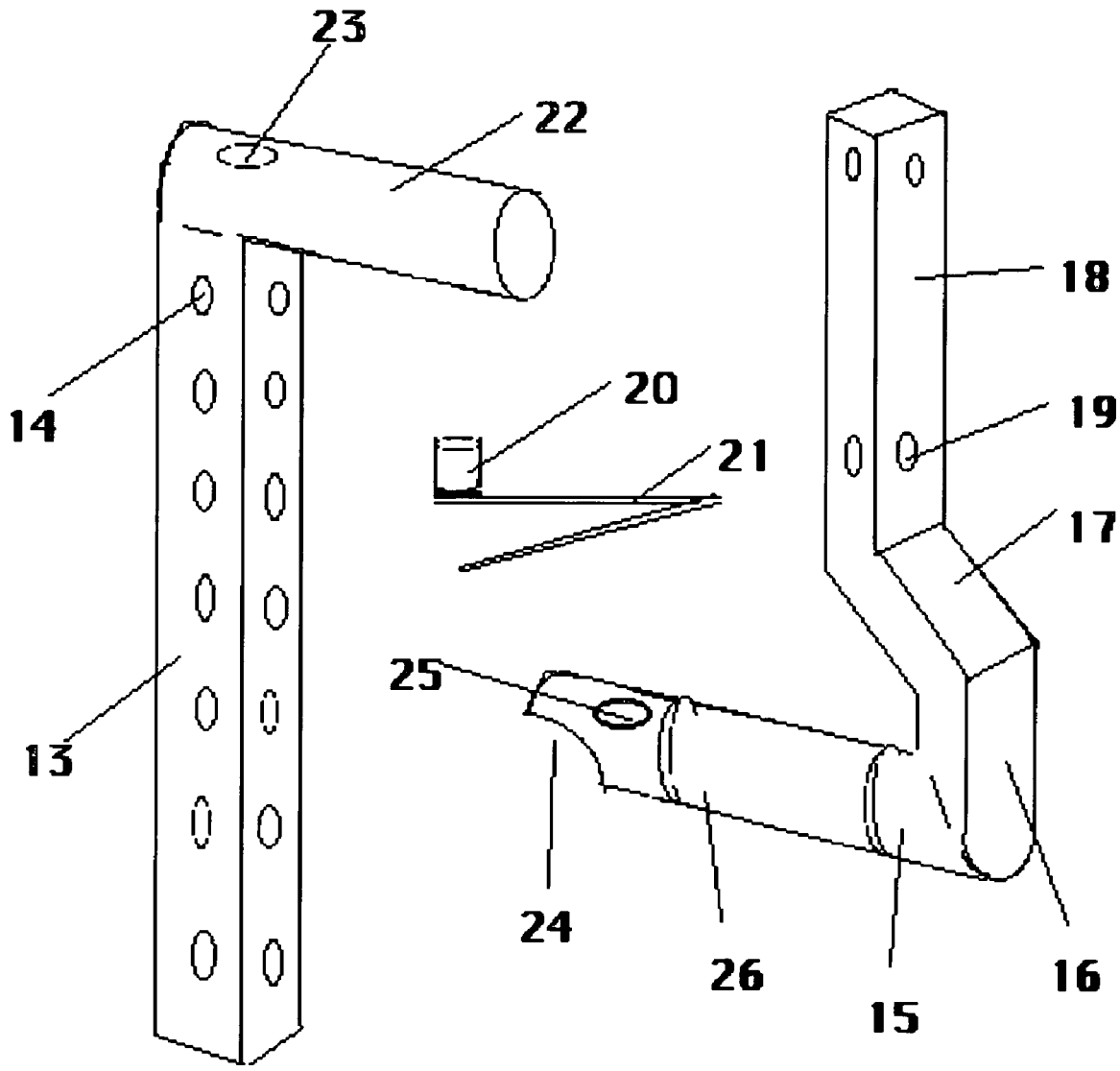
FIG. 6 is a side elevation view of an exploded handle extender assembly from the hand grip assembly unit.

FIG. 6 best illustrates the handle extender assembly as constructed in the shape of an inverted L. It has four distinct parts to it's construction. The first being a vertical insertion girder 13, this being the same make up size material as the safety bar as it fits into the other end of the main frame of the upper arm flatbed platform assembly. This vertical girder 13, is preferably made up of 1 inch square solid hollow tubing with a wall thickness of 1/16 of an inch. Second, there is a series of openings 14, on all four sides of the vertical girder 13. The preferred size of the openings are 5/16 of an inch in diameter and spaced in a row of seven one inch apart on all four sides. The purpose for the openings on the handle extender assembly is for the allowance to adjust the distance between the hand grip and the top of the arm cushion. This allows for the various lengths of forearms by different users.

The third being a hollow horizontal insertion bar 22, that is permanently attached at a 90 degree right angle at the upper end of the vertical insertion girder 13. It is preferred that the horizontal insertion bar 22, be of the same material as the vertical bar 13, but with a round circumference. It is preferred here that the vertical portion of the handle extender assembly can be inserted into the tube of the vertical shaft 13, of the upper arm flatbed platform assembly in two directions. This differing of direction allows for the differing hand grip position the user can assume while using this device.

FIG. 6 illustrates that on top of the horizontal insertion bar, and 1 and ¼ of and inches from the corner joint, is a round opening 23, preferably 5/16 of an inch in diameter. This opening is for the allowance for the rod 20, of v spring button 21, that is placed inside of the horizontal insertion bar 22, to protruded through. The fitting of the horizontal insertion bar into the hollow grip 15, of the hand grip unit forms the entirety of FIG. 5 The rod and v spring button 21, contracts with moderate hand pressure and retracts by assuming it original shape while holding it's place by pressing against the inside wall of the horizontal insertion bar 22. The shape and diameter of the horizontal insertion bar 22, is to accommodate the shape of the hand grip portion 15, of the hand grip unit assembly.

Figure 5:
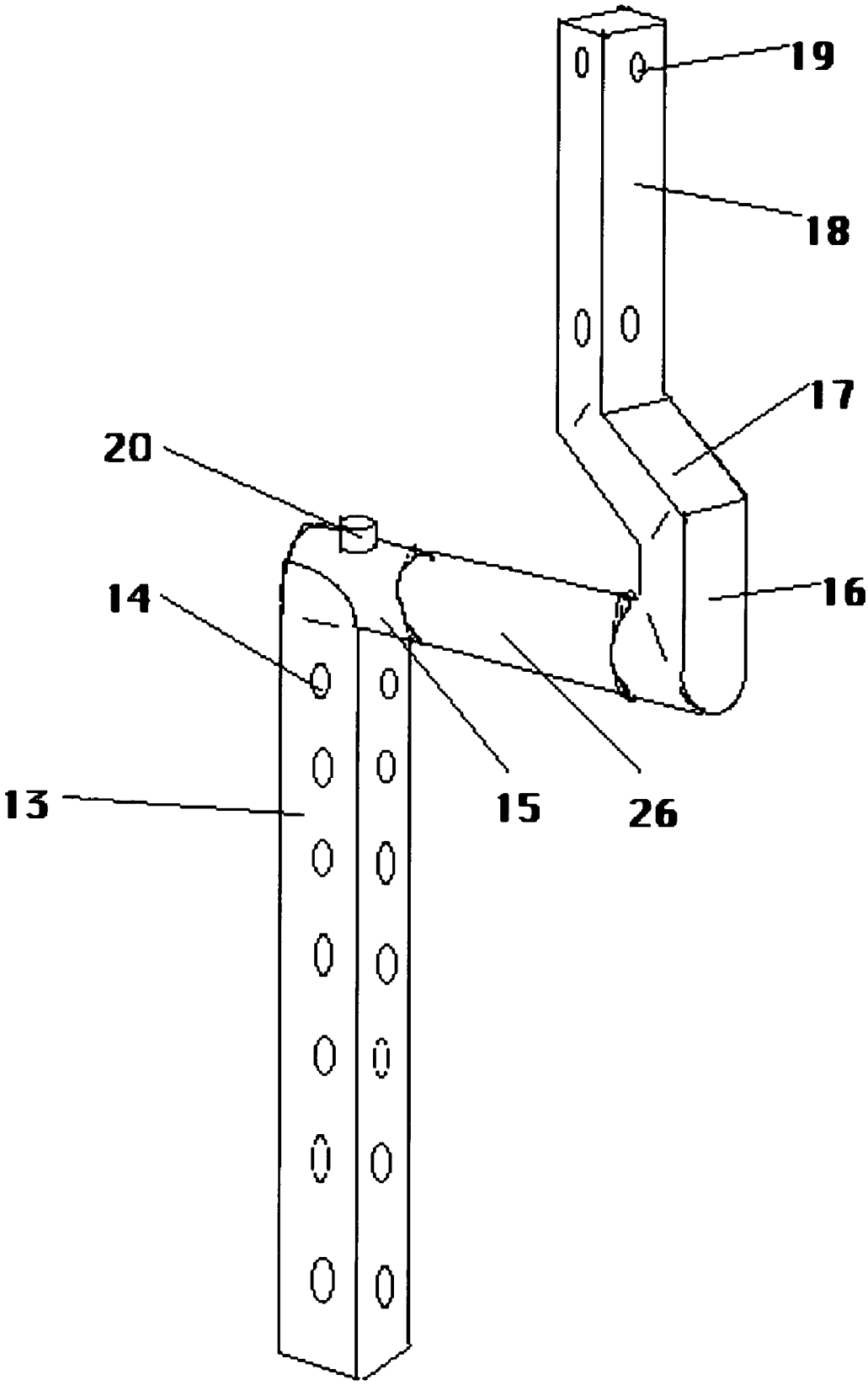
FIG. 5 is a side elevation view of a handle extender assembly connected to the hand grip assembly unit.

FIG. 5 & FIG. 4. will now explain in a different way the relationship of the handle extender and the upper arm flat bed platform assembly. The square shape of the handle extender vertical bar tube 13, when inserted into the square shape of the upper arm flat bed platform vertical shaft 10, achieves a more stable unit of strength as refers to side to side movement. This being said the relationship of these parts allows for a working parallel alignment with each other and a working perpendicular alignment with each other. while not compromising the integrity of it's support and strength.

The dimensions as it refers to the handle extender. Has a preferable vertical length of 14 inches, while the horizontal insertion bar 22, has preferable a length of 5 inches.

FIG. 6 illustrates the hand grip unit as described here is in the shape of an inverted 7 it construction has three different angles and five distinct portions to it. It should be made of a hard sturdy material that does not bend or break while under stress of holding human weight. Preferably metal, aluminum, or hard plastic resin mold. The horizontal section 15, should be hollow and have a round circumference preferably 1 and ¼ inches in diameter and 8 inches in length On the top of the round hand grip length is an opening 25, preferably 5/16 of and inch in diameter, this opening 25, should be 1 and ¼ inches from the end of the grip. The hand grip has a rubber or vinyl covering 26, which reduces friction to the palms of the hands. On one end of the grip there is a 3 inch spacing girder 16, attached at a 90 degree right angle, the purpose of this spacing girder 16, is for the allowance of space between the users fingers and the existing overhead bar. Attached to the 3 inch vertical spacing girder 16, is another 3 inch spacing girder 17, angled at a right 45 degree angle, back toward the center of the hand grip. This spacing girder 17, allows for displacement and proper balance whereby user fingers are always positioned directly under the existing overhead bar. This girder 17, should prevent the device from tipping from right to left, or from front to back while in use. The final extension 18, is preferably 8 inches long and is attached at a left 45 degree angle. This top extension 18, when attached to the rest of the assembly should be perpendicular with the hand grip portion 15, of the assembly, thereby forming the inverted 7 shape. This top girders purpose is when it is applied through the back shaft 34, of the top hook and secured by removable pen 41, is to accommodate various heights of the users and for various heights of existing overhead bars. At the open end of the 8 inch long round solid hollow tubing of the hand grip unit is cut a 1 and ¼ inch wide, 1 inch long opening 24, on the bottom half of the tube. This opening is so that when the round insertion bar of the handle extender slides into the hand grip, the end of the hand grip and the back edge of the handle extender are flush and on the same plane.

Figure 7:
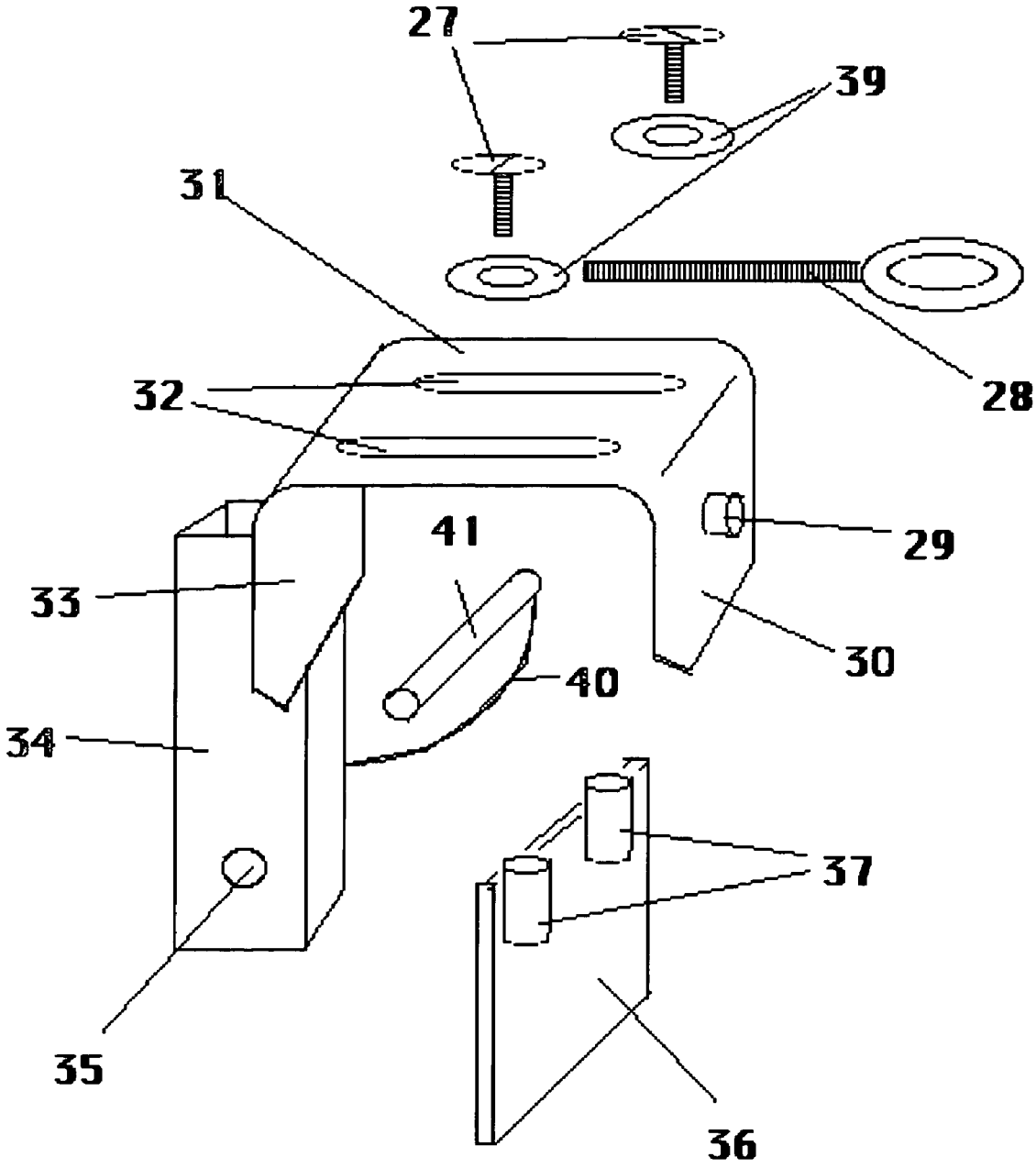
FIG. 7 is a side elevation view of an exploded top hook assembly unit.

FIG. 7 illustrates that the top hook is essentially a three sided plate that connects to the hand grip unit assembly. and clamps over and on to a existing overhead bar. The material used should be as such that it does not bend or break while under stress of a large humans weight. This plate should have a thickness equal or greater to the thickness used for the hollow tubing for the hand grip unit. Of the three sides of this unit, the top horizontal side 31, can have a width of up to 8 inches wide and a depth of up to 5 inches. It's important to note that the overall exact proportions of the top side 31, can be determined by the availability of existing overhead bars and structures that are on the market and that are being used today. As illustrated in FIG. 7, the top side 31, of the hook has two elongated openings 32, that are used as tracking for the push plate 36. These openings 32, are also used for the purpose of connecting and holding the push plate to the top side of the hook. This is achieved by utilizing a wide head transverse members 27, placed through each elongated openings 32, and then are connected to female transverse members 37, permanently attached to the top of the push plate 36. The wide head of the transverse member 27, and rubber washers 39, are wider than the width of the elongated openings 32, thereby allowing push plate 36, not to fall out of the top hook assembly. The front face of the top hook 30, has a preferable depth of 3 inches. The front face has one opening in the center. Permanently attached directly over the opening is a female transverse member 29. The female transverse member 29, which serves as a connector guide for the large transverse tightener 28. This transverse tightener 28, when twisted in and through the frontal female transverse member 29, presses the push plate 36, against the overhead bar. The push plate 36, clamps down on and secures the top hook assembly onto the users desired location on the bar. The push plate 36, and all inside walls of the top hook is lined with a thin sheet of rubber as to allow for added friction and for no scratching of the surface of the overhead bar.

FIG. 7 illustrates that the back side of the top hook 33, has the same shape and dimensions as the front side 30. Located on the back side of the top hook is the receiving shaft 34, for the top girder 18, of the hand grip assembly. The preferred size of the shaft 34, should be that of 1 and ¼ inch wide or that size that matches the width of the upper arm platform assembly's tubing 10. The top hook shaft 34, should have a length of 3 inches long and is permanently attached to top hook assembly. The ends must run in a north/south direction. Positioned on the top hook shaft sides are two round openings 35, that serve as connector points for the devices second removable pen or rod 41, and which can be attached by a cord 40, to the back side of the top hook 33.

While the present invention has been described in detail with reference to one embodiment, other changes and modifications may still be made without departing from the spirit or scope of the present invention. It is understood that the present invention is not to be limited by the embodiment described herein. Instead, the true measure of the scope of the present invention is defined by the appended claims including the full range of equivalents given to each element of each claim.

The invention claimed is:

1. A hanging fitness device for exercising abdominal muscles for use with an overhead bar, comprising:

a flatbed upper arm assembly including a lower support beam having a vertical girder extending upwardly at a right angle from one end thereof and a hollow vertical support shaft extending upwardly at a right angle from an opposed end thereof, said flatbed upper arm assembly having a generally U-shaped configuration;

a rubber tube enveloping said vertical girder to prevent friction;

an arm cushion situated atop said lower support beam generally between said vertical girder and said vertical support shaft;

a handle extender assembly including:

an insertion girder having four sides defining a plurality of openings on all four sides, said insertion girder being selectively receivable in said vertical support shaft in multiple orientations and securable therein at a selected height;

a horizontal insertion bar having a hollow round configuration attached at a 90 degree angle to a top end of said insertion girder, said horizontal insertion bar having a V-spring button;

a hand grip unit including:

a horizontal section having a hollow round configuration complementary to the configuration of said horizontal insertion bar such that said horizontal section is selectively receivable in said horizontal insertion bar and secured therein by said V-spring button;

a spacing girder extending upwardly at a 90 degree angle from one end of said horizontal section;

another spacing girder attached to said spacing girder that extends upwardly at a 45 degree angle toward a center of said horizontal section;

a top hook assembly having means for attaching to an overhead bar and having a height adjustable connector member that is coupled to said hand grip unit such that said height adjustable connector member is perpendicular to said horizontal section of said hand grip unit.

2. The hanging fitness device as in claim 1, wherein:

a back edge of said top end of said insertion girder includes an annular configuration; and a free end of said horizontal section of said hand grip unit defines an opening having a configuration complementary to a configuration of said back edge of said top end of said insertion girder such that said free end and said back edge are flush and in the same plane when selectively coupled together.

3. The hanging fitness device as in claim 1, further comprising a covering on said horizontal section of said hand grip unit constructed of a friction reducing material.

4. The hanging fitness device as in claim 1, wherein said flatbed upper arm assembly is constructed of one of metal, aluminum, or hard plastic resin.

* * * * *